US005799478A

United States Patent [19]

Legrom

[11] Patent Number: 5,799,478

[45] Date of Patent: Sep. 1, 1998

[54] SUPPORTING RING WITH REFLECTORS

[76] Inventor: Friedrich Legrom, Hauenstrasse 6, D-71540 Murrhardt-Fornsbach, Germany

[21] Appl. No.: 853,894

[22] Filed: May 9, 1997

[30] Foreign Application Priority Data

May 21, 1996 [DE] Germany ..... 196 20 377.5

[51] Int. Cl.[6] ..... D01H 4/12

[52] U.S. Cl. ..... 57/406; 57/264; 57/407

[58] Field of Search ..... 57/263, 406, 407, 57/408, 411, 413, 415, 417, 418, 264, 265

[56] References Cited

U.S. PATENT DOCUMENTS

| | | | |
|---|---|---|---|
| 4,080,775 | 3/1978 | Stahlecker | 57/34 R |
| 4,150,530 | 4/1979 | Derichs | 57/263 |
| 4,892,422 | 1/1990 | Stahlecker | 57/406 |
| 5,509,262 | 4/1996 | Stahlecker | 57/406 |
| 5,517,814 | 5/1996 | Stahlecker | 57/406 |
| 5,675,964 | 10/1997 | Stahlecker | 57/406 |

FOREIGN PATENT DOCUMENTS

| | | |
|---|---|---|
| 4121387 | 1/1993 | Germany . |
| 9314801 | 1/1994 | Germany . |
| 4313753 | 11/1994 | Germany . |
| 19511000 | 3/1996 | Germany . |

*Primary Examiner*—William Stryjewski
*Attorney, Agent, or Firm*—Walter A. Hackler

[57] ABSTRACT

A supporting ring for a supporting ring bearing of the rotor of an open end rotor spinning machine for the optical control of a joining carriage and having at least one reflecting region on an otherwise substantially non-reflecting axial ring surface (2) of the supporting ring (1) facing a light source, wherein one or more cupped receptacles (6) are provided for in the ring surface (2) into which reflectors (3) can be inserted and secured, and wherein an interruption of a rotational motion of the supporting ring (1) about a rotational axis (*4a*) is optically recognized by the joining carriage to start a joining carriage execution procedure, is characterized in that the depth of a receptacle (6) is larger than the thickness of a reflector (3) which can be placed therein. In this fashion the disadvantages of conventional supporting rings having reflectors can be avoided and optimal reflection can easily be restored at any time after wear of individual reflectors.

18 Claims, 2 Drawing Sheets

SUPPORTING RING WITH REFLECTORS

BACKGROUND OF THE INVENTION

The present invention concerns a supporting ring for a supporting ring bearing of the rotor of an open-end rotor spinning machine for the optical control of the joining carriage, having at least one reflecting region on an axial ring surface of the supporting ring which is otherwise substantially non-reflecting and which faces toward a light source, wherein one or more receptacles or recesses are provided for in the ring surface into which reflectors can be inserted and secured, and wherein an interruption of a rotational motion of the supporting ring about a rotational axis is optically recognized by the joining carriage to start a joining carriage execution procedure.

This type of supporting ring is known in the art from DE 195 11 000 C1.

Supporting rings are used in textile machines to control so-called joining carriages which join torn threads to restore this spinning location to an operative condition. A pair of parallel adjacently arranged shafts are driven within the spinning device having a so-called supporting ring disposed on each axial end so that a total of four supporting rings are provided for. One of these four supporting rings is provided with reflectors on an outwardly directed side facing a light source, e.g. a laser beam. A fraction of the light from the source which is reflected from the reflector is incident upon a measuring device, e.g. a photo cell, so that the photo cell receives a portion of the light reflected from the reflector in dependence on the rotational frequency of the supporting ring. The photo current in the photo cell is modulated by the rotational frequency of the supporting ring. When one single reflector is disposed on the ring surface, the modulation frequency corresponds precisely to the rotational frequency of the supporting ring, whereas with a plurality of reflectors on the ring surface, the modulation frequency is a multiple of the rotational frequency corresponding to the number of reflectors. In the event of failure in the open-end spinning machine, e.g. in the event of a torn thread, the supporting rings are no longer driven so that the supporting ring having reflectors turns more slowly until it stops. This reduction in rotational frequency leads to a corresponding reduction in the modulation frequency of the photo current for indication of the occurrence of the failure, e.g. of a torn thread, to suitable control electronics. When the supporting ring is stationary, a constant photo current results in the photo cell.

A supporting ring is known in the art from DE 43 13 753 A1 for the supporting ring bearing in open-end spinning rotors with which the occurrence of failure is not indicated using an optical signal unit, rather by means of a signal transmitter functioning through the use of magnetic field lines, e.g. a pin fashioned from a ferromagnetic material and integrated into the supporting ring.

A supporting ring is known in the art from DE 93 14 801 U1 with which an optical reflector made from a light thin foil is adhesively attached to the surface for failure indication. In the event of surface wear, the reflector can be replaced by glueing on a new one.

The reflector zones of this conventional supporting ring are formed by inserting a thin ring-shaped plastic disc having reflecting sectors into the side of the ring which faces the light source. These reflecting sectors are ring-shaped and generally consist of aluminum having a mirrored surface and pressed in an interlocking fashion into corresponding ring-shaped segments within the plastic disc. The plastic disc is introduced into the disc surface in a non-rotatable fashion using axially protruding clamping pins of the plastic disc which are clamped into corresponding receptacles in the ring surface.

In the supporting ring known in the art through DE 41 21 387 A1, optical reflecting zones are formed for purposes of failure indication using a thin ring-shaped plastic disc having reflecting sectors which is inserted into that side of the ring which faces the light source. Since the conventional reflecting plastic disc is only available as a solid component, it is correspondingly expensive. In addition, it is easily broken since pressure must be applied to push the plastic disc into and out of the ring surface of the supporting ring. In addition, in the event that the reflector is clamped, the plastic disc becomes soiled over the course of time with soilage gaining entrance between the plastic disc and the reflecting regions to strongly reduce the reflecting power over a period of time. Since the conventional reflecting plastic disc is a solid component, removal of deposited soilage is not possible so that a new reflecting plastic disc must be inserted into the supporting ring. In the event that the reflection is influenced, the manufacturing process is substantially hindered at this location. In addition, the reflecting plastic disc is normally securely attached to the supporting ring (for example through glueing), so that the entire supporting ring must be replaced in the event of soilage.

Finally, known in the art from DE 195 11 000 C1 is a supporting ring with which the above-described features are realized. The conventional ring has the disadvantage that, when the reflectors fail due to soilage or blinding, the entire supporting ring must be replaced in the event that the corresponding reflectors are so securely glued to the supporting ring that they can no longer be removed and replaced by new ones. Even if the glueing of the reflectors is sufficiently weak to allow for subsequent removal, exchange of the reflectors in the supporting ring is extremely inconvenient, since the outer surfaces of the reflectors in the conventional supporting ring are immediately adjacent to the surrounding ring surface so that there is no point of access for the introduction of force to non-destructively remove the reflector from the recessed receptacles in the surface of the ring. If, however, a reflector is damaged by forceful removal from the supporting ring, a broken portion of the reflector normally remains glued within the recessed receptacle which renders the replacement of the unusable reflector with a new reflector more difficult if not impossible.

It is therefore the purpose of the present invention to improve a supporting ring of the above-mentioned kind in such a fashion that the disadvantages of conventional supporting rings having reflectors are avoided, and after wear of the individual reflectors, an optimum reflection can be easily established at any time.

SUMMARY OF THE INVENTION

This purpose is achieved in accordance with an aspect of the invention in that the depth of a receptacle is larger than the thickness of the insertable reflector. In this fashion, it is possible to directly seat a new reflector on top of the old reflector whose reflecting surface has become non-usable without requiring previous removal of the old reflector.

In accordance with a second aspect of the invention, the above-mentioned purpose is achieved in that a number of holes are fashioned through the ring surface of the supporting ring which correspond to the number and position of the reflectors to be received and the reflectors have a pin for insertion into the through-hole on each of their sides facing the corresponding through-hole, and a latching device is provided for on the free end of the pin which effects a latching of the reflector against the supporting ring after insertion of the pin through the through-hole of the supporting ring.

Reflectors fashioned in this manner can be installed in a particularly simple fashion and can be exchanged or retrofitted if required. The latching device in accordance with the invention generally obviates the need for glueing the reflector to the supporting ring, since the latching offers sufficient assurance that the reflector will not fall out of the supporting ring. The supporting ring in accordance with the invention has the additional advantage that separate and expensive manufacture of a multi-component reflector insert is not necessary. Rather, it is possible to utilize small discs having reflecting surfaces which can easily be produced by stamping out a reflecting foil. This reduces the price of the reflectors enormously and allows for simple handling of the reflectors e.g. by glueing. Soilage on inaccessible locations is no longer possible and the reflecting surface can be cleaned even with rotating supporting rings, by holding a cleaning cloth at one location in the ring-shaped region traversed by the reflector during rotation of the supporting ring. In particular, due to the flat seating of the reflectors on the ring surface, it is no longer possible for soilage to gain entrance between the supporting ring and reflector and this is of decisive advantage in the relatively dirty environment within a spinning machine. Reflector discs which have become unusable as a result of wear can either be completely removed from the disc surface or be glued over with a new reflector having the same outer contours.

It is advantageous if at least two mutually diametrically opposed receptacles are formed in the ring surface to allow for configuration of the supporting ring with two reflectors, which is, in practice, the optimum number of reflectors.

An embodiment is characterized in that the depth of a receptacle approximately corresponds to an integral multiple of the thickness of the insertable reflector. In this fashion, a plurality of reflecting discs can be sequentially disposed in the receptacle on top of each other until the receptacle is completely "filled up". In the event that a subsequent reflector is introduced, same protrudes above the ring surface to indicate that the receptacle is full. Removal of all the reflectors located in the receptacle can then be indicated.

It is particularly advantageous when the reflector can be secured in the receptacle by means of a glue joint. Such a glue joint can be easily and quickly formed. For example, the reverse side of the reflector can have glue for holding same within the receptacle. Other fastening techniques are, however, possible.

In a preferred improvement of this embodiment, the reflecting side of the reflector is formed on the front side of a substrate having a self-glueing back side. The glue joint can then be effected in a particularly simple manner by removal of a foil protecting the glued surface so that an extremely rapid and simple glueing of the reflector, e.g. into the receptacle, is facilitated.

In a further particularly preferred embodiment the receptacle or receptacles is/are disposed in an annular groove concentric with the rotational axis of the supporting ring and preferentially having the width of a finger. This annular groove having, e.g. a trapezoidal cross section, facilitates simple cleaning of the inserted reflectors even with rotating supporting ring by introducing a cleaning cloth by hand into the annular groove in a controlled fashion. In this fashion a guided, safe cleaning is facilitated during rotation of the supporting ring.

It is preferred when the supporting ring is formed of a single unit to further reduce supporting ring production costs.

The supporting ring is preferentially made from plastic which further reduces the manufacturing costs and minimizes the weight of the supporting ring.

A preferred embodiment is characterized in that the reflector is fashioned as a simple geometric figure, preferentially round. The reflector can also, however, have corners to define a particular orientation of the reflector in a receptacle. A regular polygon shape has the additional advantage of allowing for improved surface utilization of the base material from which the reflector is stamped out since, in contrast to round shapes, the distribution can be fashioned in such a manner that very little waste is generated.

It is furthermore advantageous if the supporting ring is surrounded by a non-reflecting, preferentially black jacket. This allows for an easier adjustment of the reflection light source relative to the supporting ring.

A reflector for insertion into a supporting ring of the above-described kind is also within the framework of the invention which distinguishes itself in that the latching device comprises a latching edge disposed on a free end of the pin which is preferentially circumferential and which projects beyond the girth of the pin in the radial direction, a bevelled insertion surface, which is preferentially conical, as well as a longitudinal slot containing the axis of the pin.

In an additional advantageous embodiment the reflector in accordance with the invention comprises a preferentially non-transparent injection-molded component having the reflector element disposed thereon. The shape, size as well as mechanical and optical properties of this type of injection-molded component can be easily adjusted to the particular needs of the supporting ring manufacturers or to those of the spinning machine manufacturers. In addition, an injection-molded component of this type is extremely inexpensive to produce.

In an improvement of this embodiment, the reflector element comprises a preferentially self-glueing reflecting foil glued onto the injection-molded component which is easily commercially available and inexpensive.

Improved sideward mounting is effected in embodiments in which the reflector element is secured in a recessed receptacle in the injection-molded component of the reflector.

Embodiments of the reflector in accordance with the invention are possible with which the reflector element is disposed on a surface of the reflector which, when installed, faces away from the supporting ring. In this manner the reflector element is always externally accessible and could even be exchangeable when the reflectors are snapped into the supporting ring. In addition, soilage on the surface of the reflector element can be easily wiped away at any time.

In order to improve removal of possible soilage on the reflector element, advantageous improvements provide that the surface of the reflector containing the reflector element has a preferentially circumferential bevelled joining surface in the edge region.

In other embodiments of the reflector in accordance with the invention, the reflector element is disposed on a surface of the reflector facing the supporting ring in the installed state and the injection-molded portion of the reflector is transparent. In this case, the reflector element is completely inaccessible from the outside and the flat seating of the reflector on the supporting ring prevents soiling, e.g. through sideward penetration of dirt. In addition, the reflector element is thereby protected from mechanical damage, such as scratching.

An alternative embodiment of the reflector in accordance with the invention is also advantageous with which the reflector is a single-piece transparent plastic component, preferentially an injection molded component having a reflector section, preferentially in the form of a cat's eye structure, integrated into the surface facing the supporting ring in the installed state. A single piece injection molded component of this type is particularly economical to produce in large quantities. There is no need for additional installation of a reflector element.

Further advantages of the invention can be extracted from the description and the drawing. The above-mentioned features and those to be further described below can be utilized in accordance with the invention individually or collectively in arbitrary combination. The embodiments shown and described are not to be considered as exhaustive enumeration rather have exemplary character only for illustration of the invention.

DESCRIPTION OF THE PREFERRED EMBODIMENTS

Figure 1:
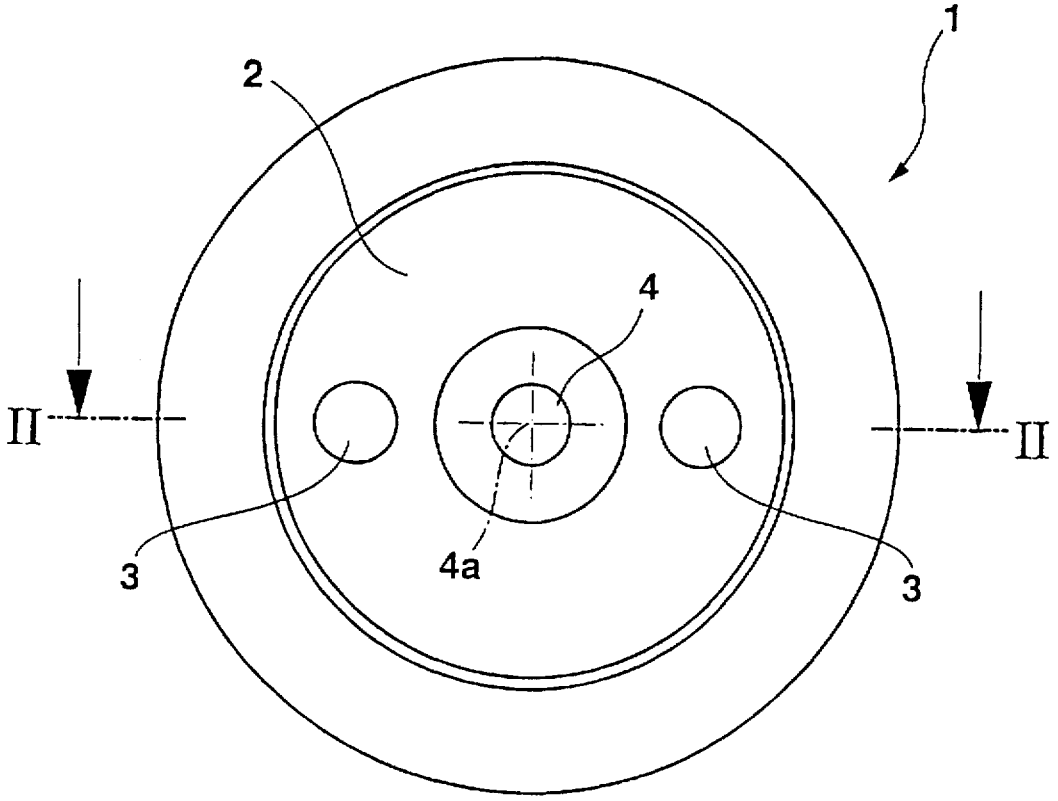
FIG. 1 shows a front view of the reflector ring of an embodiment of the supporting ring in accordance with the invention.

FIG. 1 shows a supporting ring 1 having two precisely diametrically opposed reflectors 3 disposed on the ring surface 2 which faces a light source in the installed state. The supporting ring 1 has a central through-hole 4 through which a shaft is guided in the installed state.

Figure 2:
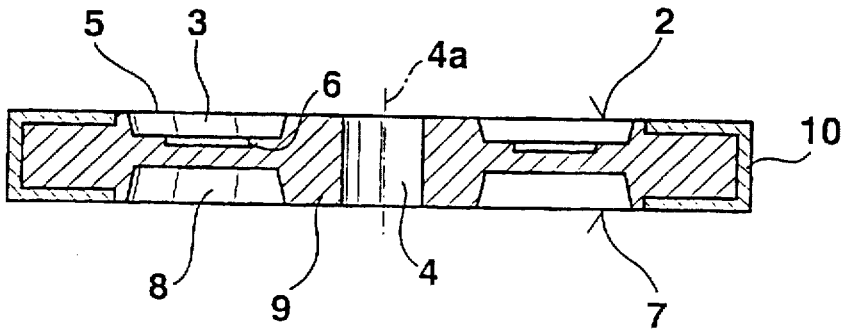
FIG. 2 shows a cross section through the supporting ring in accordance with FIG. 1 along the cut line II—II.

As can be particularly seen from FIG. 2, an annular groove 5 having trapezoidal cross section is formed in the ring surface 2 and is concentric with the axis of rotation 4*a*. Two cupped receptacles 6, having round cross sections, are formed in this annular groove 5 which, in the embodiment, are diametrically opposed. A reflector 3 having a round cross section corresponding to the cross section of the receptacle 6 is inserted into each of these two receptacles 6 and secured therein, e.g. using glue. Small discs having a reflecting surface can be utilized as reflectors 3 and can be easily produced by stamping or cutting-out a reflector foil. These reflector discs preferentially have a self-glueing back side so that the reflecting discs can easily be securely glued into the receptacles 6 after removal of a protecting foil.

The trapezoidal annular groove 5 has the approximate width of a finger so that a cleaning cloth can be introduced by hand into the annular groove 5 in a defined fashion during rotation of the supporting ring 1. In this manner a guided and therefore safe cleaning of the reflectors 3 is possible despite rotation of the supporting ring.

The back side 7 of the supporting ring 1 is fashioned in accordance with its application. In the embodiment, same has an additional concentric annular groove 8. The through-hole 4 is lengthened through an extension 9 on the back side 7 to improve the rotational performance.

The supporting ring 1 is outwardly covered by a substantially U-shaped black ring jacket 10. This non-reflecting ring jacket 10 facilitates easy alignment of the reflection light source relative to the supporting ring 1.

Figure 3:
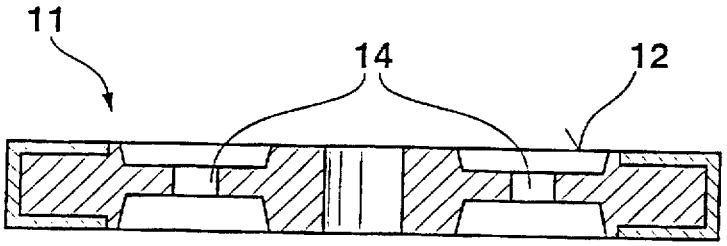
FIG. 3 shows a cross section through an additional embodiment of the supporting ring having a through-hole.

FIG. 3 shows a cross section through an additional embodiment of the supporting ring 11 in accordance with the invention which distinguishes itself from the supporting ring 1 shown in FIGS. 1 and 2 in that through-holes 14 are provided for in the ring surface 12 for attachment of reflectors.

Figure 4A:
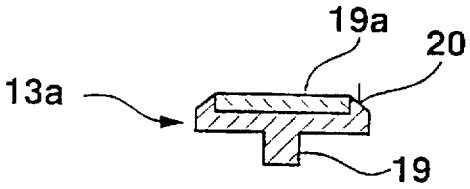
FIG. 4*a* shows a cross section through a reflector in accordance with the invention having pins.

An embodiment of a reflector 13*a* is shown in FIG. 4*a* having a pin 19 on its back side which can be inserted into a through-hole 14 of a supporting ring 11 in accordance with FIG. 3. The reflector 13*a* comprises an injection molded component into which a reflector element 19*a* is inserted in an appropriate recessed receptacle in the surface opposite to the pin 19. The surface of the reflector 13*a* adjacent to the pin 19 can, for example, be glued to the corresponding opposing surface of the supporting ring 11 to securely mount the reflector 13*a* onto the supporting ring 11. In addition, the reflector 13*a* has a circumferential bevelled joining surface 20 in the edge region of the surface containing the reflector element 19*a* which simplifies cleaning should the reflector element 19*a* become soiled.

Figure 4B:
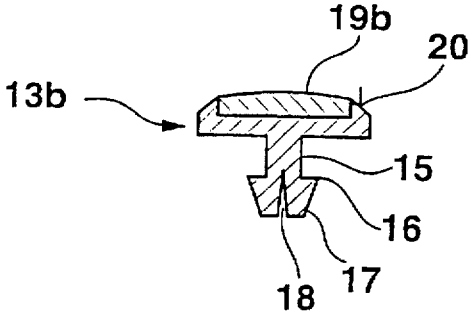
FIG. 4*b* shows a cross section through a reflector in accordance with the invention having a latching device and an externally disposed reflector element.

An additional embodiment of the reflector 13*b* in accordance with the invention is shown in FIG. 4*b* having a latching device on the back-side of pin 15 comprising a support edge 16 which projects beyond the girth of the pin 15 in the radial direction, a conically shaped bevelled insertion surface 17 for easier insertion of the pin 15 into the through-hole 14 as well as a longitudinal slot 18 containing the axis of the pin 15. The longitudinal slot 18 of the pin 15 is pushed together during introduction into the through-hole 14 of the supporting ring 11 so that the support edge 16 fits within the diameter of the through-hole 14. Following passage through the through-hole 14 the halves of the pin 15 separated by the longitudinal slot 18 spring apart again so that the support edge 16 latches on the oppositely lying end of the through-hole 14 to guarantee secure mounting of the reflector 13*b* to the supporting ring 11.

Similar to the reflector 13*a* shown in FIG. 4*a*, the reflector 13*b* also contains a reflector element 19*b* in a recessed receptacle in the surface lying across from the pin 15 which is preferentially glued to the normally non-transparent injection molded base of the reflector 13*b*.

Figure 4C:
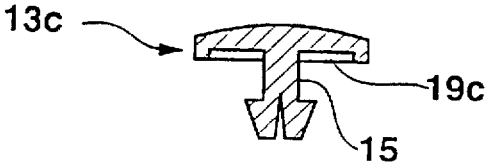
FIG. 4*c* shows a cross section through a reflector in accordance with the invention having a latching device and an internally disposed reflector element.

FIG. 4*c* shows a cross section through an additional embodiment of the reflector 13*c* in accordance with the invention with which the injection molded base is transparent. The reflector 13*c* has a reflector element 19*c* which is preferentially glued in a corresponding recessed receptacle located around the pin 15. In the event that the reflector 13*c* is illuminated with light at its surface lying across from the pin 15, the light initially penetrates through the transparent injection molded component, is reflected by the reflector element 19*c*, and exits again through the same surface of the reflector 13*c*.

Figure 4D:
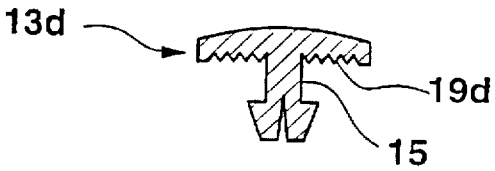
FIG. 4*d* shows a cross section through a reflector in accordance with the invention having a latching device and an inwardly integrated reflector section.

Finally, FIG. 4*d* shows a cross section through another embodiment of the reflector 13*d* in accordance with the invention which, rather than being a glueable reflector element in a region about the pin 15, is instead fashioned as a single piece and having a reflector section 19*d* which is integrated into the transparent injection molded component. In contrast to the reflector 13*c* in accordance with FIG. 4*c*, it is hereby no longer necessary to mount a reflector element onto the injection molded component. The solid single-piece reflector 13*d* is therefore particularly economical to produce. There is no danger of soilage of the back-sided reflector section 19*d* since same is in close surface contact with the supporting ring 11 in the mounted state.

In the above-described reflectors 13*a*, 13*b*, and 13*c* in accordance with the invention, the reflector elements 19*a*, 19*b*, and 19*c* are preferentially manufactured from self-glueing reflecting foil and are therefore easily introduced onto the injection molded component.

In embodiments of the reflector in accordance with the invention which are not shown, it is possible for a reflector element to be inserted through e.g. a sideward slot in the outer periphery of the injection molded base. The reflector element can be glued to the injection molded component for secure mounting. In these embodiments the injection molded component must at least have a transparent outer surface.

In general, it is important for the reflectors to be absolutely symmetric with respect to the central axis of the supporting ring, since even the smallest of non-roundnesses could lead to huge centrifugal forces at the conventional revolution velocities of up to 30,000 revolutions per minute, which would finally tear the reflector from the supporting ring. The shape of reflector is thereby irrelevant; i.e. the reflector can be round, have corners, be polygonal or be sector-shaped.

I claim:

1. An optical control device for a rotor of an open-ended rotor spinning machine to control a joining carriage in cooperation with a light source, an interruption of a rotation motion of the optical control device about a rotational axis being optically recognized by the joining carriage to initiate a joining carriage execution procedure, the optical control device comprising:

a support ring for a supporting ring bearing supporting the rotor having a substantially non-reflecting surface facing the light source, said support ring having a cupped receptacle having a depth; and a reflector seated in said cupped receptacle, said reflector having a thickness less than said depth.

2. The device of claim 1, wherein said depth is an integral multiple of said thickness.

3. The device of claim 1, wherein said reflector is glued in said receptacle.

4. The device of claim 3, wherein said reflector comprises a substrate and a reflecting surface on a front side of said substrate, said substrate having a self-glueing back side.

5. The device of claim 1, wherein said receptacle comprises an annular groove concentric with the rotational axis.

6. The device of claim 1, wherein said reflector is round.

7. The device of claim 1 further comprising a non-reflecting jacket surrounding said support ring.

8. The device of claim 7, wherein said reflector comprises an injection molded component having a mounted reflector element.

9. The device of claim 8, wherein said injection molded component is non-transparent.

10. The device of claim 8, wherein said reflector comprises a self glueing reflecting foil glued onto said injection molded component.

11. The device of claim 8, wherein sail reflector element is mounted into a recessed receptacle in the injection molded component.

12. The device of claim 8, wherein said reflector element is disposed on a surface of said reflector facing away from said support ring.

13. The device of claim 12, wherein a surface of said reflector containing said reflector element has a bevelled joining surface in a border region.

14. The device of claim 8, wherein said reflector element is disposed on a surface of said reflector facing said support ring and wherein said injection molded component is transparent.

15. An optical control device for a rotor of an open-ended rotor spinning machine to control a joining carriage in cooperation with a light source, an interruption of a rotational motion of the optical control device about a rotational axis being optically recognized by the joining carriage to initiate a joining carriage execution procedure, the optical control device comprising:

a support ring for a supporting ring bearing supporting the rotor having a substantially non-reflecting surface facing the light source, said support ring having a receptacle having a depth and a through hole; and a reflector seated in said receptacle, said reflector having a thickness less than said depth, said reflector comprising a pin on a side facing said through hole for insertion into said through hole, said pin having a latching means on a free end thereof to latch said reflector, to said support ring after insertion of said pin through said through hole.

16. The device of claim 15, further comprising a non-reflecting jacket surrounding said ring.

17. The device of claim 8, wherein said latching means has a peripheral support edge disposed on the free end of said pin and projecting beyond a girth of said pin in a radial direction, a bevelled guiding insertion surface, and a longitudinal slot containing an axis of the pin.

18. The device of claim 15, wherein said reflector is a single piece transparent plastic component having a reflector section integrated into a surface facing said support ring.

* * * * *